US006256972B1

(12) United States Patent
Savio

(10) Patent No.: US 6,256,972 B1
(45) Date of Patent: Jul. 10, 2001

(54) DEVICE TO AUTOMATICALLY CUT THE SLUBBING OF A YARN BEING WORKED

(75) Inventor: Paolo Savio, Pordenone (IT)

(73) Assignee: Atex SpA (IT)

( * ) Notice: Subject to any disclaimer, the term of this patent is extended or adjusted under 35 U.S.C. 154(b) by 0 days.

(21) Appl. No.: 09/360,207

(22) Filed: Jul. 23, 1999

(30) Foreign Application Priority Data

Jul. 27, 1998 (IT) ..... UD98A0134

(51) Int. Cl.[7] ..... D01H 13/18
(52) U.S. Cl. ..... 57/264; 57/86
(58) Field of Search ..... 57/264, 78, 80, 57/86, 81, 87

(56) References Cited

U.S. PATENT DOCUMENTS

| | | | | |
|---|---|---|---|---|
| 539,869 | * | 5/1895 | Holland et al. | 57/86 |
| 3,322,013 | * | 5/1967 | Felix | 57/86 X |
| 3,751,896 | * | 8/1973 | Ford | 57/87 |
| 4,023,341 | * | 5/1977 | Saino et al. | 57/81 |
| 4,176,514 | * | 12/1979 | Stalder | 57/264 X |
| 4,404,791 | * | 9/1983 | Wolf et al. | 57/264 X |
| 4,656,822 | * | 4/1987 | Meissner et al. | 57/81 |
| 4,922,702 | * | 5/1990 | Meyer | 57/87 |
| 5,211,709 | * | 5/1993 | Hussey | 57/87 |
| 5,758,482 | * | 6/1998 | Hoover | 57/87 |

* cited by examiner

*Primary Examiner*—Rodney Lindsey
(74) *Attorney, Agent, or Firm*—Akin, Gump, Strauss, Hauer & Feld, L.L.P.

(57) ABSTRACT

Device to automatically cut the slubbing, or spinning sliver, (11) of a yarn being worked, the device being used in any textile machine whatsoever and comprising a cutting assembly and sensor means (18) functionally associated with the cutting assembly, the sensor means (18) being suitable to detect the presence or absence of the yarn (11*a*) downstream of the draft and to activate the cutting assembly at least when they do not detect the presence of the yarn (11*a*), the cutting assembly comprising a support with which a blade is associated, the blade being movable with respect to the support to selectively assume an inactive position of non-interference with the slubbing (11) passing through or a cutting position in which it abuts against a contrasting element to cut the slubbing (11) transversely, the cutting assembly (17) comprising an electromagnet (21) and a magnetic element (35) suitable to cooperate with the movable blade (26) to keep it constrained to the core (21*a*) of the electromagnet (21) to assume the inactive position (26*a*), the electromagnet (21) being able to be temporally activated to generate a magnetic field suitable to take the blade (26) to the cutting position (26*b*), against the action of the magnetic element (35).

8 Claims, 3 Drawing Sheets

DEVICE TO AUTOMATICALLY CUT THE SLUBBING OF A YARN BEING WORKED

BACKGROUND OF THE INVENTION

This invention concerns a device to automatically cut the slubbing of a yarn being worked as set forth in the main claim.

The invention is applied in the textile field and particularly, though not exclusively, in spinning machines.

The device according to the invention is suitable to quickly interrupt the feed of the slubbing, or spinning sliver, every time an anomalous event occurs in the working cycle and particularly when the yarn accidentally breaks due to the drawing operation.

In the following description particular reference will be made to a use of the invention in a spinning machine, but this application must not be taken as a limitation of the invention.

DETAILED DESCRIPTION OF THE INVENTION

The state of the art includes spinning machines wherein a slubbing, taken from a reel or similar, is subjected to drawing and torsion to achieve a yarn which is progressively wound into coils on a cop keyed onto a rotating spindle.

In a ring-type spinning machine, for example, the slubbing is drawn by a drawing assembly comprising at least two pairs of counter-rotating rollers through which the slubbing is made to pass; by making the pairs of rollers arranged upstream rotate at a speed less than that of the pairs of rollers arranged downstream, a defined value of drawing is obtained.

As the yarn is wound onto the cop, it often happens that the yarn breaks downstream of the drawing assembly, which causes the yarn to wind around the outlet rollers of the drawing assembly.

Given the high speeds of feed which are at present achieved by textile machines, if this disadvantage is not immediately identified by the workers, it can lead to quite a considerable mass of yarn being wound onto the drawing rollers, which results in a considerable quantity of material being discarded, and also, possibly, the mechanical organs may break.

Moreover, this mass of yarn is usually removed by using very sharp blades, which are dangerous for the workers; this operation also requires a long time, which considerably reduces the productivity of the machine. Using such blades, moreover, may often lead to the surface of the rollers of the drawing assembly being damaged, as it is usually covered with cloth, skin, rubber or other synthetic materials, which necessarily requires the damaged rollers to be replaced, to avoid repercussions on the final quality of the yarn produced.

In some cases, moreover, the free end of the broken yarn may wind around an adjacent yarn being worked, and this is damaged too.

To prevent these problems, various devices have been proposed suitable to interrupt the feed of the slubbing every time that there is an accidental breakage of the yarn downstream of the drawing assembly.

Such devices comprise a sensor located downstream of the drawing assembly suitable to detect the presence of the passing yarn and to signal when it is absent by activating cutting means located immediately upstream of the said drawing assembly. The intervention of the cutting means prevents the slubbing which is still wound on the reel from being able to wind onto the drawing rollers or the free end of the yarn from interfering with other functional organs of the spinning machine or with the other yarns being worked.

The state of the art includes a device with a first disk with which a helical torsion spring is coaxially associated, suitable to be charged to make the disk rotate by a defined angle.

A blade is associated tangentially to the disk and is suitable to cooperate with a fixed surface, located at a defined distance from the disk; the slubbing is made to pass between the blade and the fixed surface.

The disk is suitable to selectively assume an inactive position wherein the blade is distanced from the slubbing or a working position wherein the blade abuts on the surface and cuts the slubbing.

The inactive position of the disk is maintained by a second, rotary disk having a peripheral shaping suitable to temporarily accommodate a small peg orthogonally associated with the first disk.

The second disk can selectively assume a clamped position wherein it clamps the peg, and hence the first disk, or an unclamped position wherein it releases the peg, allowing the first disk to rotate to move to the working position.

The second disk is held in the clamped position by a retaining tooth, which can be activated by an electromagnet, suitable to cooperate with a mating groove arranged radially on the second disk.

By activating the electromagnet it is possible to make the retaining tooth retreat, and hence to release the second disk and, consequently, to release the first disk which moves to the working position allowing the blade to cut the slubbing.

When the electromagnet is de-activated, the retaining tooth returns to its original position, thanks to an extension spring.

Even if this device may be considered efficient from an operational point of view, it consists of a high number of components and therefore has high costs, it takes a long time and is difficult to assemble. Moreover, it has some components, for example, the springs, which are subject to wear or may easily break.

The present Applicant has devised and embodied this invention to overcome these shortcomings and to obtain other advantages as will be shown hereafter.

SUMMARY OF THE INVENTION

The invention is set forth and characterised in the main claim, while the dependent claims describe other characteristics of the main embodiment.

The purpose of the invention is to provide a device suitable to automatically cut the slubbing, or sliver, of a yarn being worked, every time an anomalous event occurs which could compromise the functioning of the machine, the quality of production or the safety of the workers.

To be more exact, the device according to the invention is suitable to intervene downstream of the support which feeds the slubbing when there is an accidental breakage of the yarn in a defined zone of the working travel.

A further purpose is to achieve a device with a limited number of components, economical, functional and which does not easily suffer from malfunctions.

It is also a purpose of the invention to provide a device suitable to vary its configuration to adapt to any type of spinning machine without needing to intervene on the structure of the latter.

The device according to the invention comprises, in its essential parts, sensor means suitable to signal the presence or absence of the yarn and a cutting assembly functionally associated with the sensor means.

According to the invention, the cutting assembly is activated at least when the sensor means do not detect the presence of the yarn.

The cutting assembly comprises, in its essential parts, a support which can be associated with the textile machine, a blade and an electromagnet suitable to cooperate with the blade.

The blade is suitable to selectively assume an inactive position of non-interference with the slubbing passing through, or a cutting position in which it abuts against a contrasting surface cutting the slubbing interposed between the blade and the said surface.

According to one characteristic of the invention, the blade has at least a defined magnetised zone suitable to be constrained to the core of the electromagnet, when the latter is in its de-energised condition, assuming the inactive position.

When the electromagnet is energised, a magnetic field is induced on the core suitable to take the blade to the cutting position against the action of the magnetised zone.

In the preferential embodiment of the invention, the transition from the inactive position to the cutting position takes place substantially due to the force of gravity; this allows to reduce to a minimum the number of components of the device, eliminating the mechanical organs such as levers, springs, disks or otherwise, which are needed in conventional devices for the automatic activation of the blade.

BRIEF DESCRIPTION OF THE DRAWINGS

These and other characteristics of the invention will become clear from the following description of a preferred form of embodiment, given as a non-restrictive example, with reference to the attached drawings wherein.

DETAILED DESCRIPTION OF THE INVENTION

Figure 1:
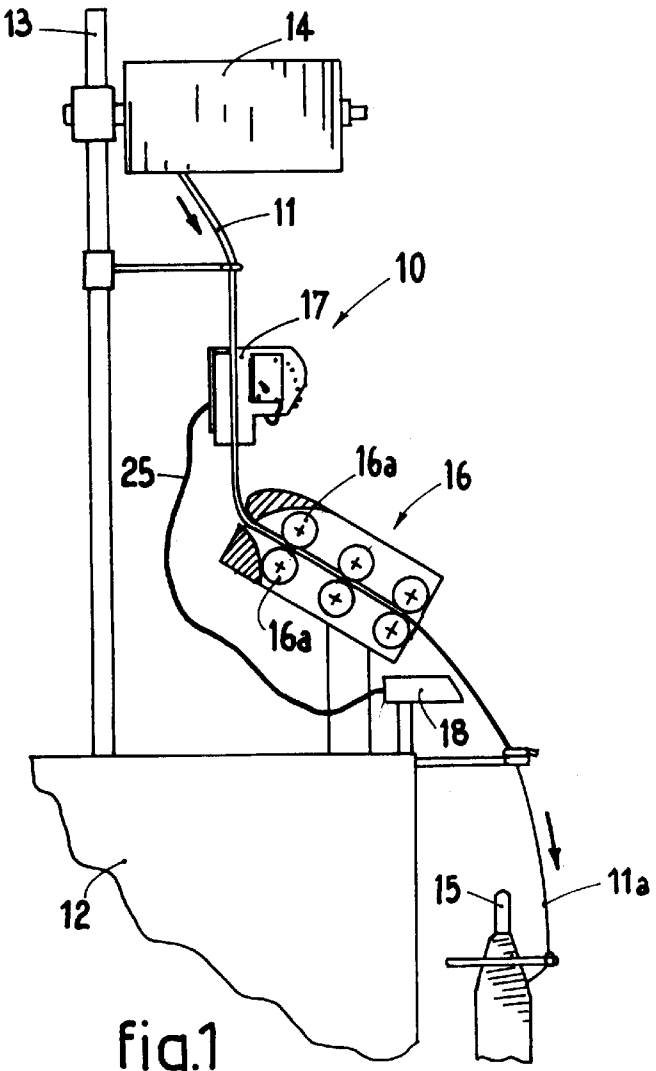
FIG. 1 shows a schematic side view of a spinning machine using the device according to the invention.

With reference to FIG. 1, a device 10 according to the invention to automatically cut the slubbing 11 of a yarn being worked is installed on a spinning machine 12.

The spinning machine 12 comprises a creel 13 with which a plurality of reels 14 are associated, each of which feeding a respective slubbing 11 which is to be subjected to drawing and torsion so as to achieve a yarn 11*a* which is wound onto a cop keyed onto a spindle 15.

The drawing is performed by a drawing assembly 16, of a conventional type, comprising three pairs of rollers 16*a*, opposite and counter-rotating, through which the slubbing 11 is made to pass.

The device 10 according to the invention comprises a cutting assembly 17 and a sensor 18, suitable to detect the presence or absence of the yarn 11*a*, installed respectively upstream and downstream of the drawing assembly 16.

The sensor 18 may be of any type whatsoever, such as optical, capacitive, piezoelectric or even mechanical.

In the embodiment shown here, the sensor 18 is of the optical type and comprises a luminous source in the field of infra-red and a light-sensitive detector element; the ray of light emitted by the source is reflected by the yarn and detected by the light-sensitive element.

When the yarn accidentally breaks, the light emitted by the source is not detected by the light-sensitive element and the sensor 18 emits a defined electric signal, through a cable 25.

Figure 2:
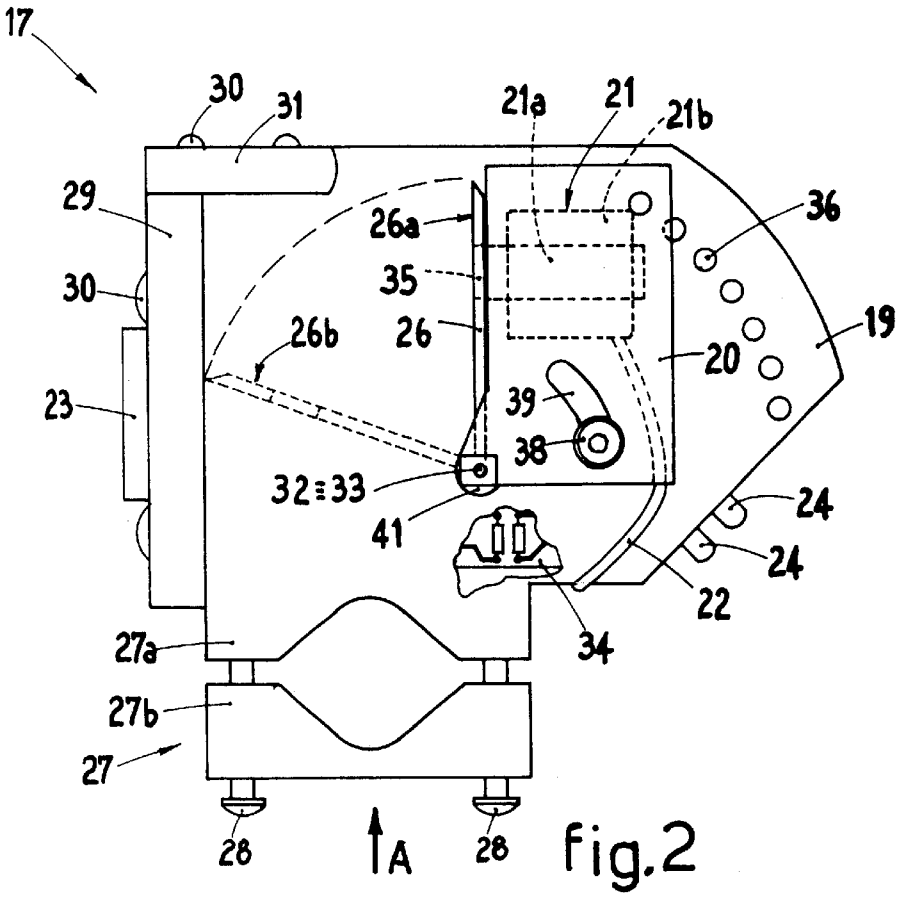
FIG. 2 is a detailed view of the device according to the invention.
Figure 3:
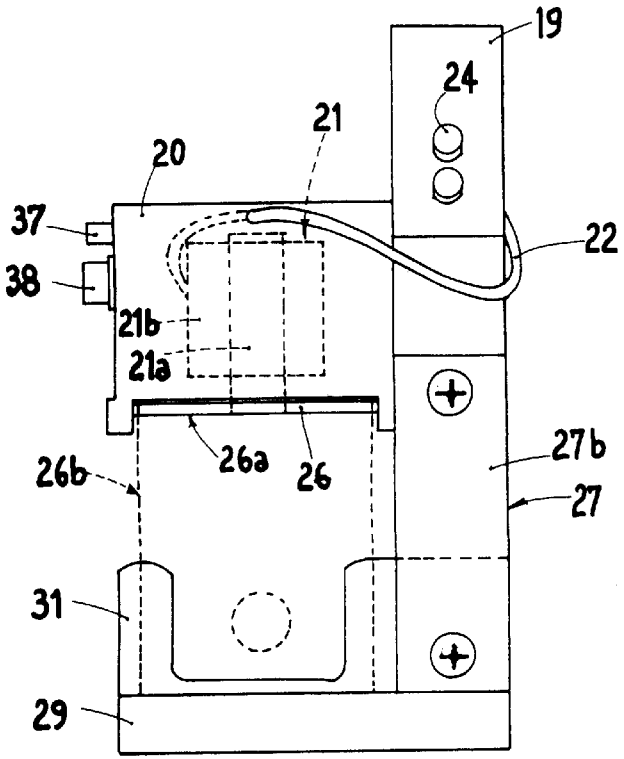
FIG. 3 is a view from A of FIG. 2.

The cutting assembly 17, shown in detail in FIGS. 2 and 3, comprises a support 19 with which an actuator assembly 20, described in greater detail later, is adjustably associated.

The support 19 is equipped underneath with constraining elements 27 which allow to associate it with the structure of the spinning machine 12.

In this case, the constraining elements 27 comprise two opposite jaws, respectively 27*a* and 27*b*, suitable to be brought together by tightening two lateral screws 28.

A plate 29 and a substantially U-shaped guide element 31 are associated respectively with the sides of and above the support 19, in this case by means of screws 30.

The support 19 is associated with the spinning machine 12 in such a manner that, under normal working conditions, the slubbing 11 passes inside the U defined by the guide element 31, but without interfering with the elements 29 and 31.

The actuator assembly 20 has a box-like structure inside which a conventional electromagnet 21 is housed, indicated with a line of dashes, consisting of a core 21*a* and a solenoid 21*b*.

The electromagnet 21 can be associated with the box-like structure in any way whatsoever, for example embedded in a jet of thermosetting resin.

The solenoid 21*b* is connected electrically to an electronic card 34 (FIG. 2) by means of a cable 22.

The electronic card 34 is housed inside the support 19 and is equipped with an inlet/outlet connector 23 and signalling leds 24, one red and one green, emerging from the support 19. The connector 23 is connected to the cable 22, to the cable 25 and also to a feed cable which is not shown here.

Figure 7:
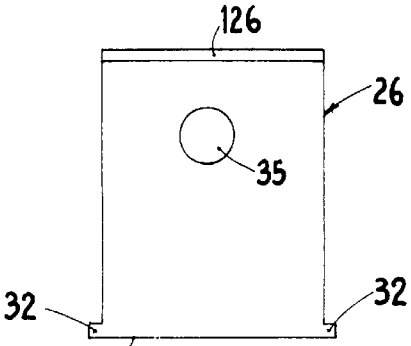
FIG. 7 is a plane view of the blade of the device according to the invention.

According to one characteristic of the invention, the actuator assembly 20 cooperates with a metal blade 26, shown in detail in FIG. 7, suitable to selectively assume an inactive position 26*a* (FIG. 2) in which it is located substantially vertical and distanced from the passing slubbing 11 or a cutting position 26*b* (FIG. 4) in which it is located sloping and interferes with the slubbing 11.

In the cutting position 26*b*, the edge 126, milled to 45°, of the blade 26 abuts against the plate 29, clamping the slubbing 11 which, due to the drawing movement imparted by the drawing assembly 16, becomes gradually thinner until the fibers of which it is composed are completely separated.

The blade 26 abuts against the plate 29 with an angle of incidence $\alpha$, a little less than 90°.

Together with the milling of the edge 126 of the blade 26, this allows the slubbing 11 to draw the blade 26 in its movement, making the cutting action extremely efficient.

At the sides of the edge 226, opposite the edge 126, the blade 26 has respective protrusions 32 suitable to be inserted into corresponding holes 33 made in the lower corners of the box-like structure of the actuator assembly 20. Said protrusions 32 act as rotation pins for the blade 26 which moves from position 26*a* to position 26*b* and vice versa, oscillating with respect to the holes 33.

According to the invention, in a position corresponding to the core 21*a* of the electromagnet 21, the blade 26 has a permanent magnet 35. This magnet 35 is suitable to be constrained to the core 21*a* of the electromagnet 21 when the latter is not energised.

According to one characteristic of the invention, the magnetic field generated by the electromagnet is of the opposite sign to that of the magnetic field possessed by the permanent magnet 35; in this way, when the electromagnet 21 is activated, the magnetic field it produces is suitable to repel the permanent magnet 35, consequently distancing the blade 26.

Figure 4:
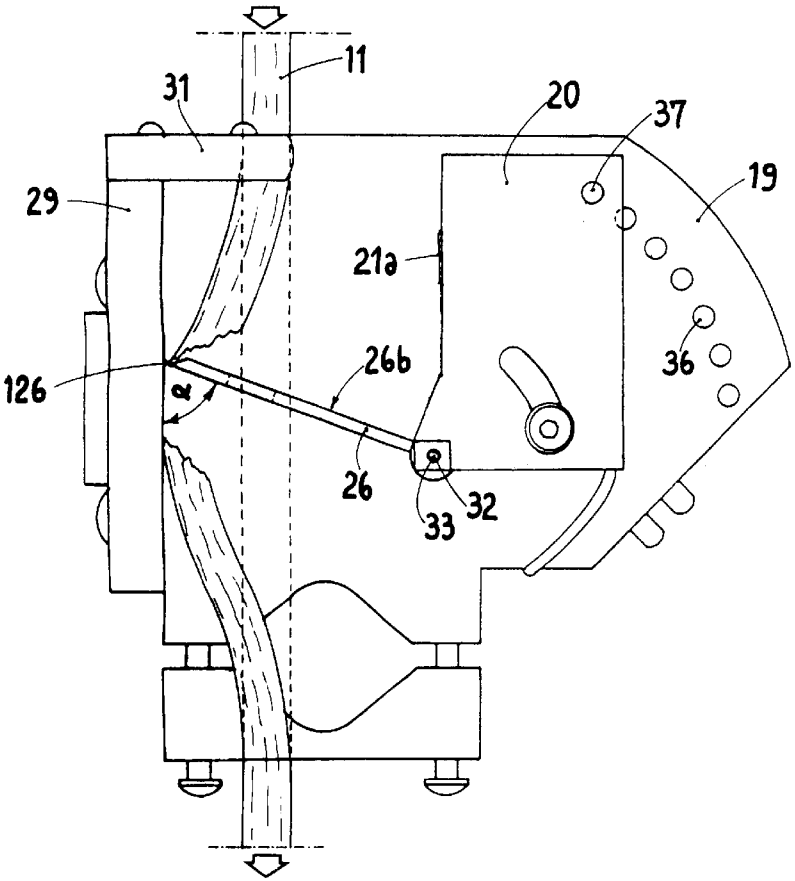
FIG. 4 shows the device of FIG. 2 during the cutting of the slubbing.

The device 10 according to the invention functions as follows:

When the spinning machine 12 is functioning under normal conditions, the blade 26 is in the inactive position 26*a*, the electromagnet 21 is de-energised, the green led 24 is lit and the slubbing 11 passes through the cutting assembly 17 remaining substantially parallel to the plate 29, as shown in FIG. 4 with a line of dashes.

When the sensor 18 does not detect the presence of the yarn 11*a*, because it has accidentally broken, it sends a signal by means of the cable 25 to the electronic card 34 which, by means of the cable 22, sends a current impulse to the solenoid 21*b*.

This current impulse induces a magnetic field on the core 21*a* suitable to repel the permanent magnet 35 mounted on the blade 26.

This causes the metal blade 26 to move away; due to the force of gravity and the additional force impressed by the magnetic field of the energised electromagnet 21, the blade 26 oscillates with respect to the hole 33 until it stops against the plate 29, thus assuming the cutting position 26*b*.

When this happens, the red led 24 lights up, making it easier for the worker to identify the cutting assembly 17 that has intervened.

Once the intervention to restore normal working conditions has been carried out, the blade 26 is returned manually to its inactive position 26*a*.

With this invention, therefore, a current impulse to activate the electromagnet 21, of extremely limited intensity and duration, is sufficient to activate the blade 26, with the advantage that energy consumption is minimal.

According to one characteristic of the invention, the configuration of the cutting assembly 17 can be changed to adapt to any kind of textile machine whatsoever, thus allowing to assemble more than one cutting assembly 17 in parallel, and optimising the spaces available.

Figure 6:
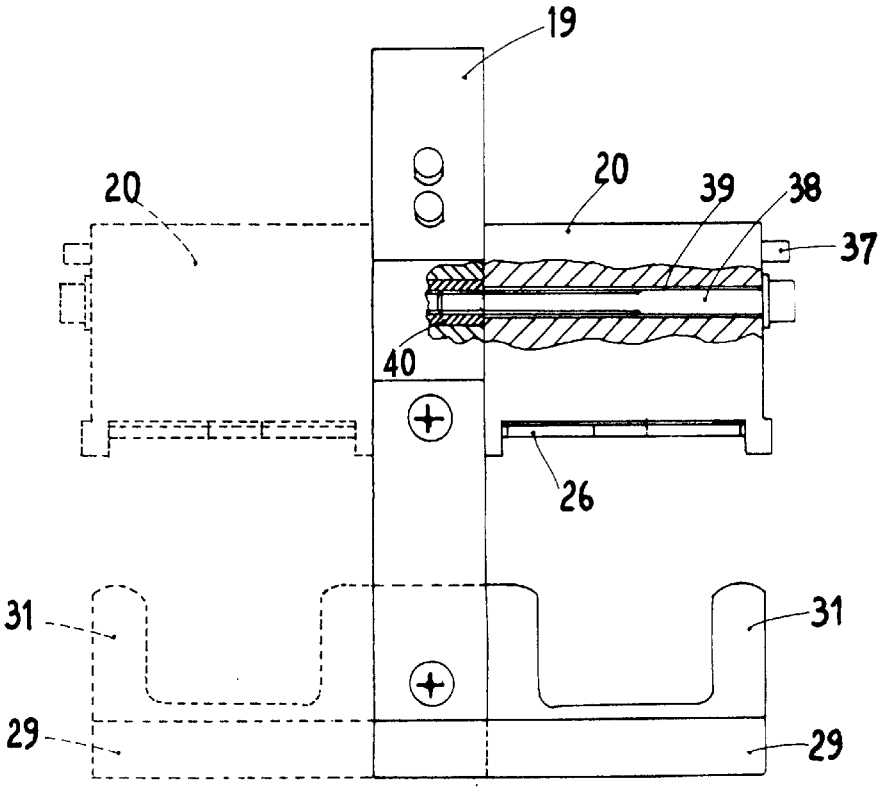
FIG. 6 shows a variant of FIG. 3.

As shown in FIG. 6, in fact, the actuator assembly 20, the plate 29 and the guide element 31 can be assembled either on the right or on the left of the support 19.

Figure 5:
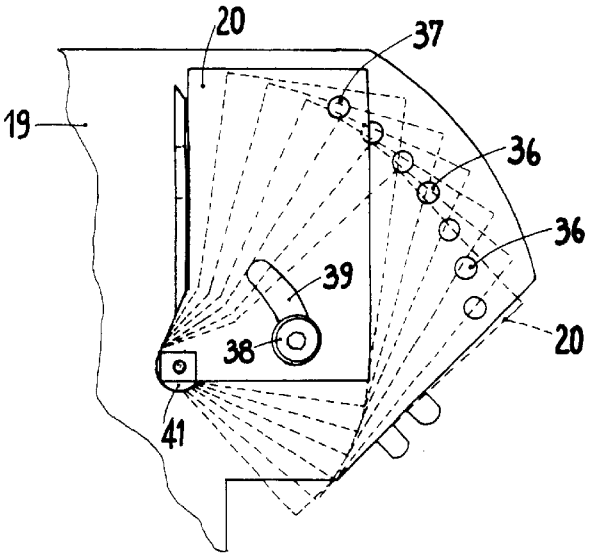
FIG. 5 shows a detail of FIG. 2.

As shown in detail in FIG. 5, the support 19 is equipped with a plurality of through holes 36, in this case seven, arranged in an arc of a circle and inside which a peg 37 is suitable to be inserted, solid with the box-like structure of the actuator assembly 20.

The actuator assembly 20 is associated with the support 19 by means of a screw 38 inserted into an eyelet 39 and which can be tightened in a threaded bushing 40 solid with the support 19 (FIG. 6).

The ends of the actuator assembly 20 equipped with the holes 33 protrude towards the outside so that they are inserted in a corresponding hole 41 made on the support 19.

These protrusions act as a rotation pin for the actuator assembly 20, so that, when the screw 38 is temporarily unscrewed, it is possible to selectively insert the peg 37 into one of the holes 36.

This makes possible to vary the inclination of the blade 26 with respect to the plate 29, when it is in the inactive position 26*a*, in this case by multiples of 7.5°.

This characteristic is particularly useful to adapt the cutting assembly 17 to the normal arrangement assumed by the slubbing 11 when it is being worked.

It is obvious that modifications or additions may be made to this invention, but these shall remain within the field and scope thereof.

For example, the actuator assembly 20 may be fixed and the plate 29 may be able to oscillate.

I claim:

1. Device to automatically cut the slubbing, or spinning sliver, (11) of a yarn being worked, the device being used in any textile machine whatsoever and comprising a cutting assembly (17) and sensor means (18) functionally associated with the cutting assembly (17), the sensor means (18) being suitable to detect the presence or absence of the yarn (11*a*) downstream of a draft and to activate the cutting assembly (17) at least when they do not detect the presence of the yarn (11*a*), the cutting assembly (17) comprising a support with which a blade is associated, the blade being moveable with respect to the support to selectively assume an inactive position of non-interference with the slubbing (11) passing through or a cutting position in which it abuts against a contrasting element to cut the slubbing (11) transversely, the cutting assembly (17) including an electromagnet (21) and a magnetic element (35) suitable to cooperate with the moveable blade (26) to keep it constrained to the core (21*a*) of the electromagnet (21) to assume the inactive position (26*a*), the electromagnet (21) being able to be temporarily activated to generate a magnetic field suitable to take the blade (26) to the cutting position (26*b*), against the action of the magnetic element (35), the blade (26) and the electromagnet (21) being associated with an actuator assembly (20) the position of which can be regulated with respect to the support (19).

2. Device as in claim 1, characterised in that the magnetic element (35) consists of a permanent magnet mounted on the blade (26) and cooperating with the core (21*a*).

3. Device as in claim 1, characterised in that the blade (26) is metallic and is equipped at a first end with pins (32) suitable to allow it to oscillate to move from the inactive position (26*a*) to the cutting position (26*b*) and vice versa.

4. Device as in claim 2, characterised in that the blade (26) passes from the inactive position (26*a*) to the cutting position (26*b*) substantially due to the force of gravity.

5. Device as in claim 1, characterised in that the actuator assembly (20) is equipped with an eyelet (39) inside which a screw (37) is inserted suitable to be tightened in a mating threaded hole (40) made on the support (19) and with a peg (37) suitable to be inserted in a hole (36) selectively selected from a plurality of holes (36) arranged in an arc of a circle on the said support (19).

6. Device as in claim 1 suitable to be used in a spinning machine comprising in sequence a support (13) for reels (14) to feed the slubbing (11), a drawing assembly (16) and a spindle (15) to twist and wind the slubbing (11), characterised in that the cutting assembly (17) and the sensor means (18) are locatable respectively upstream and downstream of the drawing assembly (16).

7. A device to automatically cut the slubbing, or spinning sliver, (11) of a yarn being worked, the device being used in any textile machine whatsoever and comprising a cutting assembly (17) and sensor means (18) functionally associated with the cutting assembly, the sensor means (18) being suitable to detect the presence or absence of the yarn (11*a*) downstream of a draft and to activate the cutting assembly (17) at least when they do not detect the presence of the yarn (11*a*), the cutting assembly (17) comprising a support with which a blade is associated, the blade being moveable with respect to the support to selectively assume an inactive position of non-interference with the slubbing (11) passing through or a cutting position in which it abuts against a contrasting element to cut the slubbing (11) transversely, the device being characterised in that the cutting assembly (17) comprises an electromagnet (21) and in that a magnetic element (35) is suitable to cooperate with the moveable blade (26) to keep it constrained to the core (21*a*) of the electromagnet (21) to assume the inactive position (26*a*), the electromagnet (21*a*) being able to be temporarily activated to generate a magnetic field suitable to take the blade (26) to the cutting position (26*b*), against the action of the magnetic element (35), the blade (26) and the electromagnet (21) being associated with an actuator assembly (20) the position of which can be regulated with respect to the support (19), the blade (26) in its inactive position (26*a*) is substantially vertical and in its cutting position (26*b*) abuts against the contrasting element (29) with a defined angle of incidence ($\alpha$), the contrasting element (29) and the actuator assembly (20) can be selectively associated on the right or on the left of the support (19).

8. Device as in claim 7, characterised in that the angle of incidence ($\alpha$) is a little less than 90° to allow the slubbing (11) to efficiently draw one edge (126) of the blade (26) in its movement.

* * * * *